United States Patent [19]

Henschel

[11] Patent Number: 4,630,861

[45] Date of Patent: Dec. 23, 1986

[54] FOLDABLE STOOL

[76] Inventor: Reed E. Henschel, Rte. 4, Box 33, Sundance, Wyo. 82729

[21] Appl. No.: 792,303

[22] Filed: Oct. 28, 1985

[51] Int. Cl.[4] ..... A47C 4/08

[52] U.S. Cl. ..... 297/44; 108/124; 297/175; D6/353

[58] Field of Search ..... 297/42, 44, 16, 461, 297/175, 193; 108/124, 125, 126, 134, 135; D6/349, 352, 353; 312/262

[56] References Cited

U.S. PATENT DOCUMENTS

| | | | |
|---|---|---|---|
| D. 156,324 | 12/1949 | Dastugue | D6/349 |
| D. 170,311 | 9/1953 | Doherty | D6/352 |
| 409,677 | 8/1889 | Forman | 297/42 X |
| 703,690 | 7/1902 | Young | 297/44 |
| 900,552 | 10/1908 | Kade | 108/124 |
| 3,120,076 | 2/1964 | Zuch | 312/262 X |
| 3,188,158 | 6/1965 | Sanchez | 108/124 X |
| 4,122,638 | 10/1978 | O'Brian et al. | 52/70 |

FOREIGN PATENT DOCUMENTS

| | | | |
|---|---|---|---|
| 397954 | 9/1933 | United Kingdom | 108/124 |
| 597003 | 1/1948 | United Kingdom | 297/193 |

*Primary Examiner*—William E. Lyddane

*Assistant Examiner*—Thomas A. Rendos

*Attorney, Agent, or Firm*—Kinney & Lange

[57] ABSTRACT

A foldable stool has trapezoidal sides including first and second nonfolding side walls and first and second folding end walls. Each end wall includes first and second nonfolding half-walls and a piano-type hinge connecting these half-walls to each other. A folding top wall of the stool includes first and second nonfolding top half-walls hinged together with a piano-type hinge. Piano-type hinges connect each first half-wall to the first side wall, and piano-type hinges connect each second half-wall to the second side wall. A lip portion extending horizontally outwardly from the top wall when the stool is in its upright condition is in contact with the upper edges of each of the side walls and end walls to support any weight put on the stool along the entire top edges of these side walls and end walls. A shoulder portion of the top wall is inset from the lip portion, and serves to contact the inner top edge of each of the side and end walls to hold the stool locked in its upright position when weight is applied to the stool. The four corner portions of this shoulder portion are relieved sufficiently to allow the stool to be moved between its upright condition and a folded condition.

4 Claims, 8 Drawing Figures

10
12
14
15
21
22
23
28
32
34
38
40
42

12
15
16
17
18
21
22
23
24
26
28
30
32
36
38
42
46

6
8
10
12
14
16
17
18
20
21
22
26
28
32
40
42
48

6
7
10
12
14
16
17
18
20
21
22
28
32
34
40
42
44

FOLDABLE STOOL

BACKGROUND OF THE INVENTION

1. Field of the Invention

This invention has relation to foldable stools which can easily, safely and quickly be moved between an upright condition such that they can be supported on a horizontal surface and a compact, folded condition such that they can be easily and conveniently stored or transported when not in use.

2. Description of the Prior Art

It is known to provide folding structures which can be used as dog houses, and for play structures such as, for example, "rocking boats", rocking horses and cradles. See U.S. Pat. No. 4,122,638, granted to O'Brian et al in October of 1978 and an application of O'Brian et al, Ser. No. 752,104, filed Dec. 20, 1976, and incorporated in the O'Brian patent by reference.

The disclosure of the O'Brian et al application was limited to structures where nonfolding side walls, a folding top wall, folding end walls, and a folding bottom wall were all rectangular in shape and where the several hinges which hold these walls together and permit folding were each in parallel relationship to one of mutually perpendicular X, Y or Z axes. This structure disclosed a flashing along the top edge of a roof which was "somewhat resilient in character so as to tend to act as a spring and fit sufficiently closely to the top member [of the roof] so as to serve a locking or holding function" (specification of application Ser. No. 752,104, page 8, beginning on line 18). It also disclosed an overcenter relationship of the walls and hinges, "in providing a sort of toggle-type action in connection with the action of hinges 32 and 36 connecting the end walls 28 and 30 to the side walls 12 and 14 and to one another." (Specification of O'Brian application Ser. No. 752,104, page 11, beginning on line 17). This snap-in-place action placed considerable stress on the hinges and the connection of the walls to the hinges.

The O'Brian application showed a structure which was effective for its intended purpose. However, limitation to the use of entirely rectangular relationships with all hinges pivoting on axes at right angles to other hinges resulted in a structure which was not firm and steady. As it was used more and more for play houses or for its intended purpose, as a dog house, it tended to become "rickety" and to be easily movable out of an exact rectilinear shape.

The structure of the O'Brian patent, U.S. Pat. No. 4,122,638 also relies heavily, if not entirely, on this same kind of "sort of toggle-type action", thus necessarily putting major stresses on the hinges and the connection points of the hinges with the walls. This is a particularly important point in connection with play equipment or in connection with foot stools, step stools or stools to sit upon made in accordance with the present invention.

A preliminary search was made on this invention, and the only patent cited was O'Brian U.S. Pat. No. 4,122,638, discussed above.

Neither the inventor nor those in privity with him are presently aware of any prior art which is closer than that discussed above and are not aware of any prior art which renders unpatentable any of the claims made herein.

SUMMARY OF THE INVENTION

This invention is an improvement on a folding stool which has first and second nonfolding side walls, a folding top wall which includes first and second nonfolding top half-walls and hinge means connecting these top half-walls to each other, first and second folding end walls each of which include first and second nonfolding half-walls and each including hinge means connecting its first and second end half-walls to each other, hinge means connecting each first half-wall to the first side wall, and hinge means connecting each second half-wall to the second side wall.

The improvement on this structure comprises a top wall which is provided with: (1) a lip extending outwardly to form the outer horizontal periphery of the top wall as the top wall is viewed when the stool is in its upright condition, and (2) a shoulder below and spaced inwardly of the lip around the outer periphery of the top wall. The lip portion is so positioned as to lie in supported relation to the uppermost surface of each of the side walls and each of the end half-walls when the stool is in its upright condition. The shoulder provided by a lower portion of the top wall is positioned so as to lie in inward-movement-preventing contact with the uppermost inner edge of the side and end walls when the stool is in its upright condition.

Each of the top half-walls and each of the end half-walls is movable from the upright condition of the stool into face-to-face relation with its hinged-together counterpart and each of the side walls is movable into parallel, spaced-apart relation to each other and in adjacent, encompassing, closely spaced relation to the folded end walls as the stool moves from its open to its folded condition.

DETAILED DESCRIPTION OF THE PREFERRED EMBODIMENTS

Figure 1:
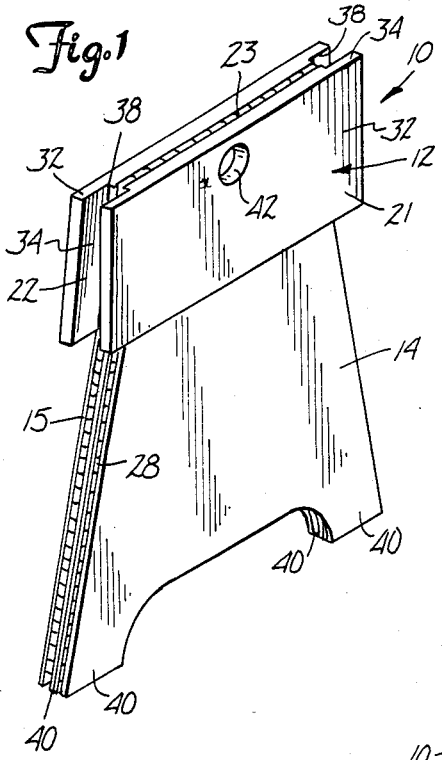
FIG. 1 is a perspective view of the foldable stool of the invention in its folded condition.
Figure 8:
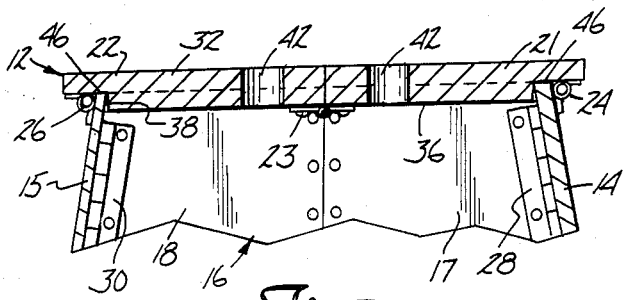
FIG. 8 is an enlarged fragmentary vertical sectional view taken on the line 8—8 in FIG. 2.

A foldable stool 10 made according to the present invention includes a folding top wall 12, first and second nonfolding, panel-like side walls 14 and 15, and a pair of folding end walls 16,16.

Each folding end wall 16 includes a first nonfolding end half-wall 17, a second non-folding end half-wall 18, and end wall hinge means 20, here shown as a piano-type hinge, connecting the end half-walls 17 and 18 to each other.

The folding top wall 12 includes first nonfolding top half-wall 21, second nonfolding top half-wall 22, and top wall hinge means 23 here shown as a piano-type hinge, connecting top half-walls 21 and 22 to each other.

Hinge means 24, here shown as a piano-type hinge, connects the first top half-wall 21 to the first side wall 14; while a similar hinge means 26 connects the second top half-wall 22 to the second side wall 15.

A piano-type hinge or other hinge means 28 connects the first end half-wall 17 to the first side wall 14 while a piano-type hinge or other hinge means 30 connects the second end half-wall 18 to the second side wall 15.

As clearly seen in FIGS. 1, 3, 6, 7 and 8, each of the nonfolding top half-walls 21 and 22 which form part of the folding top wall 12 include an upper portion 32 providing a rectangular lip portion 34 extending outwardly to define the outermost periphery of the top wall 12 when the stool 10 is in its upright position as in FIGS. 2, 6, 7 and 8. Extending downwardly from the upper portion 32 of the top wall 12 is a lower portion 36 of the wall 12 which is smaller in outer peripheral dimension than lower portion 36 provides a shoulder 38 extending around the entire periphery of the top wall 12 when the stool 10 is in its upright position.

In the form of the invention as shown, each of the side walls 14 and 15, each of the folding end walls 16,16, and each of the nonfolding end half-walls 17 and 18 which form parts of the end walls 16 are trapezoidal in outer dimension. The extremities of each of the side walls 14 and 15 and of each of the folding end walls 16,16 are provided with downwardly extending feet 40; and the bottom surfaces of those feet define a single plane whether the stool 10 is in the folded or upright position.

Each of the nonfolding top half walls 21 and 22 are provided with lift means or openings 42,42 for a purpose which will be described later.

Figure 4:
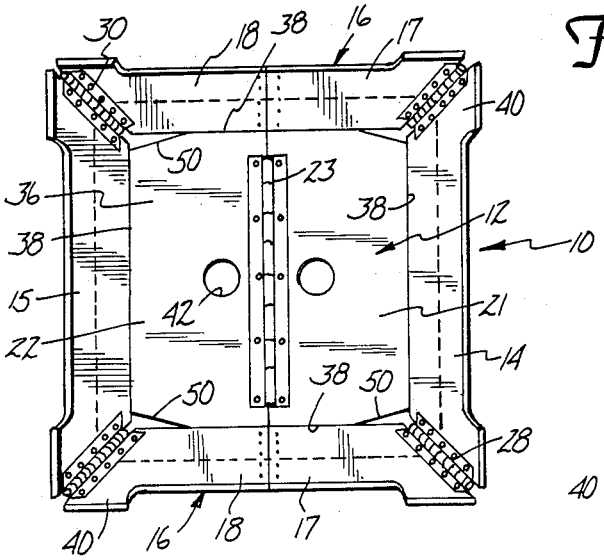
FIG. 4 is a bottom plan view of the stool in its "upright" position as seen in FIG. 2.
Figure 5:
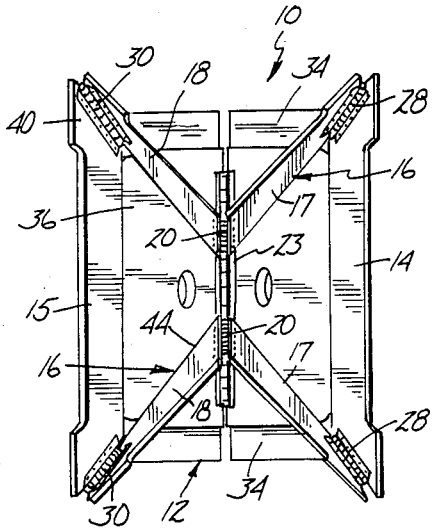
FIG. 5 is a bottom plan view of the stool as seen in FIG. 3.
Figure 6:
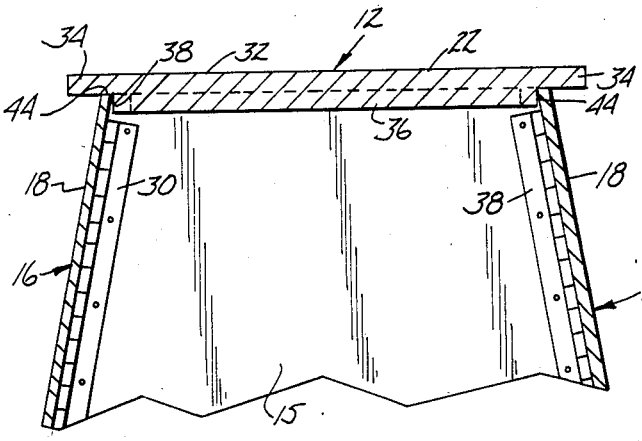
FIG. 6 is an enlarged fragmentary vertical sectional view taken on the line 6—6 in FIG. 2.

As best seen in FIGS. 4 and 6, when the stool is in its upright position, top edge portions 44 of each of the end half-walls 17 and 18 rest against the shoulder 38 provided by the lower portion 36 of the top wall 12 and prevent inward movement of the hinged portion of these end half-walls. Similarly, as best seen in FIG. 6, these top edge portions 44 of each folding end wall 16,16 come into weight-bearing, supporting relationship with respect the lip 34.

Figure 7:
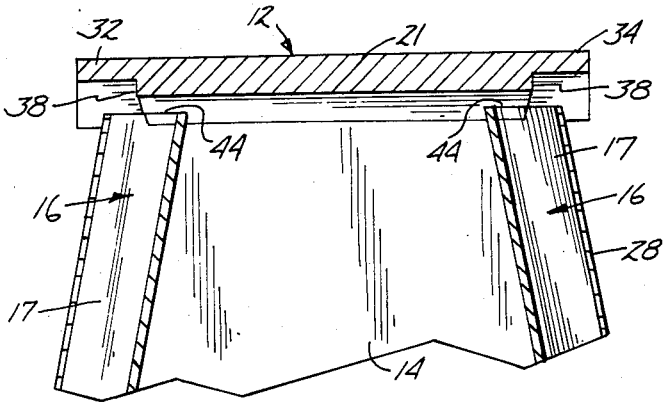
FIG. 7 is an enlarged fragmentary vertical sectional view taken on the line 7—7 in FIG. 3.

As best seen in FIG. 7, top edge portions 46 of each of the side walls 14 and 15 likewise come into contacting relationship with shoulder 38 and into weight-bearing, supporting relationship with respect to lip 34.

Figure 2:
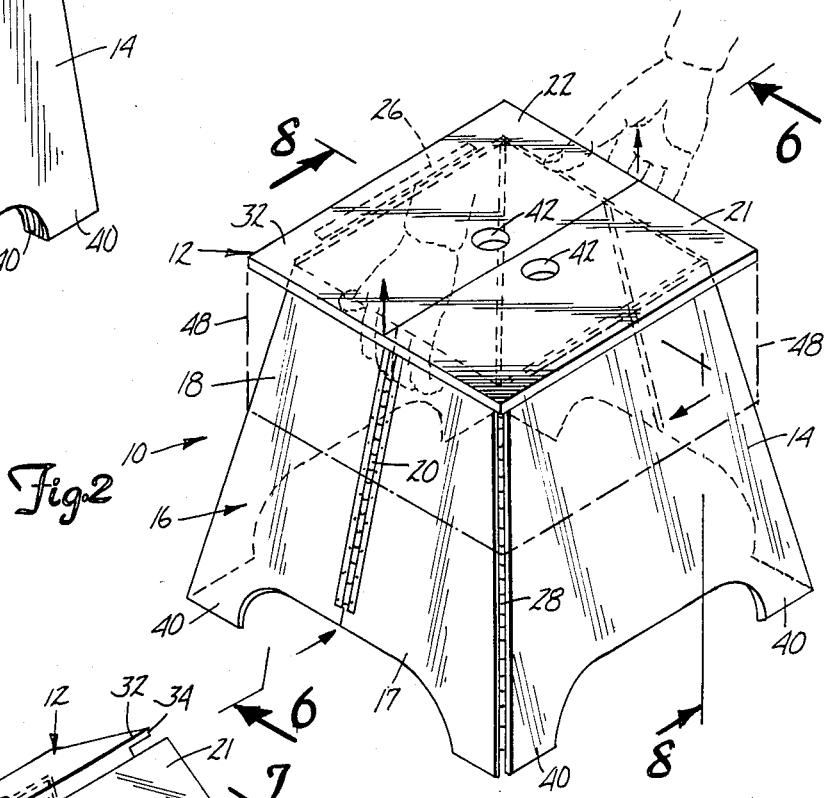
FIG. 2 is a perspective view of the stool of FIG. 1 in its upright condition showing the hands of a user in a position to institute moving of the stool from that condition to its folded condition.

It will be evident from this relationship that the more weight which is put on the stool 10 while in its upright position, the more firmly the trapezoidal shape and the bearing of the top edge portions 44 and 46 of the end walls and side walls against the shoulder 38 will increase the stability of the stool. Since all of the top edge portions 44 and 46 are firmly in contact with the bottom surface of the lip 34, even if weight is placed unevenly on the stool to the extent of placing it directly over the lip, the stool will remain firmly positioned on any horizontal surface. Construction lines 48 extending perpendicularly downwardly from the outer corners of the lip 34 of the top wall 12, as seen in FIG. 2, makes it clear that the feet 40 are outside of vertical planes coincident with the outermost periphery of the wall 12, so there will be no tendency for the stool to tip over as long as all weight on the stool 10 is placed directly on some portion of the top wall.

Were the top edge portions 44 of the end walls 16,16 to be solidly in contact with the shoulder 38 throughout the length of those top edge portions, once the stool was assembled, it would be impossible to move it from the upright to the folded condition. This is so because for the top wall to raise, the side walls must begin moving toward each other, and this can only happen as the end walls begin to fold inwardly. Thus it is necessary that some upward movement of the folding top wall 12 be provided sufficiently for the center, hinged portions of the top edge portions 44 of the half-walls 17 and 18 of the end walls 16,16 to be cleared by the center, hinged-together portions of the top half-walls 21 and 22 of the top wall 12. This is accomplished by providing a "lost motion" beveled ramp at the outer ends of the lower portions 36 of the wall 12 which face toward the end walls 16,16. As best seen in the bottom plan view of FIG. 4, this "lost motion" is provided by beveling those portions of the shoulder 38 immediately adjacent the top edge portions 44 of the first and second end half-walls 17 and 18.

As a practical matter, it has been found that this "lost motion" can be provided by trimming away the shoulder 38 along the line of contact of the shoulder 38 with top edge portions 46 of first and second side walls 14 and 15 back from each of the 4 corners by an amount approximately equal to the vertical dimension or thickness of the shoulder 38 and then by continuing to cut away from each of these points on a straight bevel to form a ramp 50 which meets with the original shoulder 38 adjacent top edge portions of folding end walls 16,16 at points which are about eight times the dimension of the thickness of the shoulder 38 from the corner.

FOLDING AND OPENING OPERATION

In its upright condition, the stool 10 can be used as a step stool in a kitchen, for example, to reach articles stored on high shelves; it can be used as a step stool to put on the ground outside of a vehicle such as a train or a bus, for example, to allow easy embarking and debarking; as a foot stool; and as a seat for use in doing filing at a low level. Actually a 240 pound professional athlete has experimentally tested the device many thousands of times by stepping up on it and stepping down again in the process of developing and conditioning his legs. Thus, it will be understood that the stool has very great utility while it is in its upright condition Since the stool folds up to have an overall thickness of little more than twice the thickness of the top wall plus about twice the folded thickness dimension of the end walls when it is folded condition, it can easily be stored when not in use in a household, on a vehicle, or can be easily packed away for shipment or transport when carried and used, for example, by a professional athlete who travels constantly from city to city in performing his services.

In order to provide the excellent stability when in the upright condition and in order to be folded to such a small width in the folded condition, the stool must be handled or operated in a particular way to move it between its open condition and its folded condition. It is this operation which will now be described.

Assuming that the stool is in its folded condition as seen in FIG. 1, in order to move it to its open condition, it can be set upright on a floor or other horizontal surface, and the user should take hold of the outer lip portions 34 of the first top half-wall 21 and of the second top half-wall 22 directly vertically below the lift means or openings 42,42. The operator will then lift simultaneously on these lip portions to raise the feet 40 off of the ground, while moving his hands apart to allow the folding top wall 12 to drop into its horizontal position as seen in FIG. 2. Because the top wall 12 is hinged to side walls 14 and 15, these side walls will move outwardly, opening up end walls 16,16. The momentum of these end walls moving outwardly under the force of gravity generated by the dropping of the top wall and the side walls will cause the end walls 16,16 to move to position so that each first end half-wall 17 and its connected second end-wall 18 will be in horizontal alignment with the other. This movement will cause the top edges 44 of those half-walls to clear the lower portion 36 of the then unfolding top wall 12 to allow the parts to be positioned as seen in FIGS. 2, 4, 6, 7 and 8.

If an attempt is made to move the stool from its folded condition to its upright condition without letting the parts drop in place by the force of gravity, the shoulder 38 will come into an interfering and binding relationship with the top edge portions 44, and the stool will not open entirely. This is an advantage because it prevents the possibility of injury or pain by preventing the two hinged portions of the first and second top half-walls 21 and 22 from coming into contact with each other unless and until the operator's hands are in contact with the opposite outer edge lip portions of those half-walls in order to allow the parts to drop into place as explained above.

Figure 3:
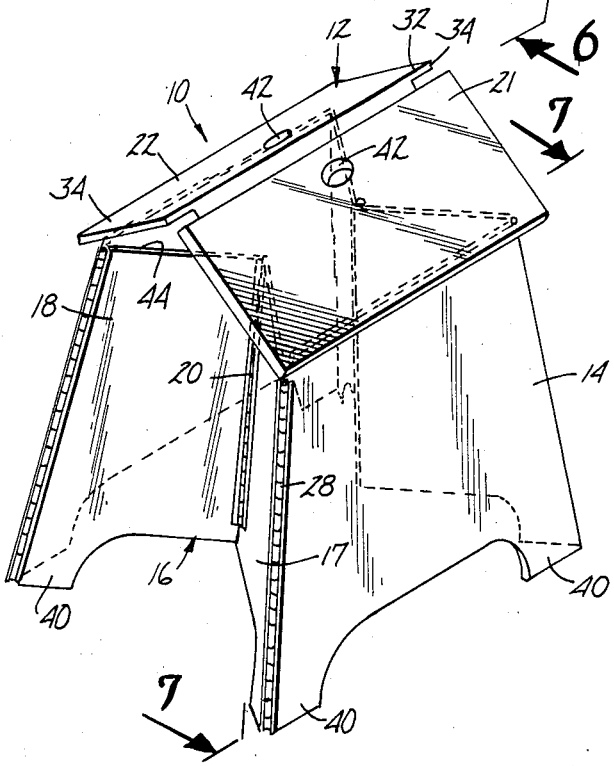
FIG. 3 is a perspective view of the stool of FIGS. 1 and 2 in an intermediate position between its folded and its upright conditions.

In order to move the stool 10 from the upright condition as seen in FIG. 2 to the folded condition of FIG. 1, the hands of the operator must be placed as seen in dotted lines in FIG. 2, and the two top half-walls 21 and 22 must be lifted simultaneously while, at the same time, the operator's fingers must push lightly against the hinged portions of both first and second end-walls 17 and 18 of each of the end walls 16,16. As soon as the shoulder 38 reaches clearing relationship with rspect to these hinged portions of the top edge portions 44 of these four end half-walls, and the stool takes the position approximately as seen in FIG. 3, the user's grip can be shifted and the remainder of the folding operation can take place with the user gripping the stool through the lift openings 42,42, for example.

Although the present invention has been described with reference to preferred embodiments, workers skilled in the art will recognize that changes may be made in form and detail without departing from the spirit and scope of the invention.

What is claimed is:

1. In connection with a folding stool movable between an upright and a folded condition, said stool having:

first and second nonfolding side walls, a folding top wall including first and second nonfolding top half-walls and hinge means connecting these top half-walls to each other, first and second folding end walls, each including first and second nonfolding half-walls and each including hinge means connecting its first and second end half-walls to each other, hinge means conneting each first half-wall to said first side wall, and hinge means connecting each second half-wall to said second side wall; the improvement wherein:

A. the top wall is provided with (1) a lip extending outwardly around the outer horizontal periphery of the top wall as the top wall is viewed when the stool is in its upright condition with the top half-walls lying in a common horizontal plane, and (2) a shoulder below and spaced inwardly of said lip around the outer periphery of the top wall;

B. said lip is so positioned as to lie in supported relation to the uppermost surface of each of said side walls and each of said end half-walls when said stool is in its upright condition;

C. said shoulder is so positioned as to lie in inward-movement-preventing contact with the uppermost inner edge of each of said side and end half-walls when said stool is in its upright condition;

D. each of said top half walls is movable into face-to-face relation with its hinged-together counterpart and said side walls being movable into parallel, spaced-apart relation to each other and in adjacent, closely spaced relation to said folded end walls to accomplish movement of said stool to said folded condition;

E. each of said end half-walls is movable into face-to-face relation with its hinged-together counterpart to lie entirely between the side walls;

F. said top wall shoulder is effective around substantially the entire periphery of the top wall to be in contacting relation with the top inner edge surface of each of said side walls and each of said end walls when said stool is in its upright condition;

G. those side-wall-contacting portions of the top wall shoulder in contact with each of said side walls each define a vertical plane coincident with substantially the entire top inner edge surface of such side wall when the stool is in its upright condition;

H. those end-wall-contacting portions of the top wall shoulder in contact with each of the folding end walls each define a vertical plane coincident with the top inner edge surface of its contacted end wall over a central hinged portion of such end wall when said stool is in its upright condition, only so much of said end-wall-contacting shoulder portions as are in adjacent relation to the side-wall-contacting shoulder portions being relieved as is needed to allow those portions of the top wall shoulder adjacent the hinged edges of the first and second end half-walls of each end wall to initially clear the tops of those end-walls as the stool is moved from upright toward folded condition; and I. said top wall shoulder is relieved by providing four ramps which are formed by cutting away all four ends of the side-wall-contacting portions of the top wall shoulder by a dimension at least approximately equal to the depth of the shoulder and cutting away all four adjacent end-wall-contacting portions of the top wall shoulder so that such ramps taper into the end-wall-contacting portions of the top wall shoulder at a point at least approximately eight times the thickness of the shoulder from the side walls when the stool is in an upright condition.

2. The invention of claim 1 wherein:

J. said first and second side walls define nonrectangular trapezoids symmetrical about a central vertical plane normal to the principle planes of the side walls; and K. said end walls define nonrectangular trapezoids which are symmetrical about a vertical plane passing through the end wall hinge means joining the end half-walls to each other when the stool is in its upright condition.

3. The invention of claim 2 wherein:

L. the second side wall is the same size as and has the same effective shape as the first side wall; and M. the second end wall is the same size as and has the same effective shape as the first end wall.

4. The invention of claim 2 wherein:

L. each hinge means connecting two separate parts of the stool to each other is constituted as a single piano-type hinge.

* * * * *